US005119942A

United States Patent [19]

McCullars

[11] Patent Number: 5,119,942

[45] Date of Patent: Jun. 9, 1992

[54] MAIL SORTING RACK

[75] Inventor: James R. McCullars, Jonesboro, Ark.

[73] Assignee: Bama Corporation, Jonesboro, Ark.

[21] Appl. No.: 618,211

[22] Filed: Nov. 26, 1990

[51] Int. Cl.[5] ..... A47F 5/00

[52] U.S. Cl. ..... 211/10; 211/151; 312/334

[58] Field of Search ..... 211/151, 10, 94.5, 133, 211/126; 312/321, 345, 330.1, 323, 270; 108/143

[56] References Cited

U.S. PATENT DOCUMENTS

| | | | |
|---|---|---|---|
| 3,465,897 | 9/1969 | Schumann et al. | 211/151 |
| 3,524,692 | 8/1970 | Preston | 312/270 X |
| 4,227,466 | 10/1980 | Rooklyn | 211/151 X |
| 4,314,734 | 2/1982 | Grunert | 312/323 X |
| 4,403,701 | 9/1983 | Corcoran | 312/270 X |
| 4,482,066 | 11/1984 | Dykstra | 211/151 |
| 4,923,070 | 5/1990 | Jackle et al. | 211/126 X |
| 5,037,163 | 8/1991 | Hatcher | 108/143 X |

*Primary Examiner*—Robert W. Gibson, Jr.
*Attorney, Agent, or Firm*—Stephen D. Carver

[57] ABSTRACT

An upright, generally cubicle sheet metal mail sorting rack for at least temporarily storing a plurality of trays filled with items of mail. Each cabinet comprises a pair of rigid, spaced apart end panels of generally rectangular dimensions. A plurality of vertically spaced apart retractable shelves are supported within the cabinet between the end panels by a dynamic mounting system. The shelves can be manually displaced from a retracted within the cabinet to an extended, tilted position facilitating tray access. The mounting system comprises a pair of segmented tracks for each shelf, and suitable wheel bearings which ride upon the tracks. Each segmented track comprises separate horizontal and angled track members mounted on the interior of the cabinet end panels. Pairs of wheel bearings project outwardly from each shelf end; front wheel bearings ride on the horizontal track and the rear wheel bearings ride on the angled track. Thrust bearings project from the shelf ends beneath the wheel bearings toward the inner surfaces of the end panels to capture the tracks to resist binding forces. The shelves are yieldably locked in either the retracted or withdrawn position by a notched, detent system defined in the tracks. One or more of the units may be employed in side-to-side relationship, and they may be arranged ergonomically in arrays of columns and rows.

16 Claims, 4 Drawing Sheets

MAIL SORTING RACK

BACKGROUND OF THE INVENTION

My invention relates generally to storage devices of the type used for mail sorting. More particularly, my invention relates to racks comprising generally cubical cabinets which support one or more shelves for storing sorting trays.

The prior art reflects a number of attempts at providing mail sorting systems. In the sorting process, a number of trays are typically used to temporarily store articles of mail being routed in different directions. These trays are arranged in regular arrays upon shelves within various cabinets. The cabinets are in turn arranged in a regular order upon the floor. It is important that the trays disposed upon the cabinet shelves be readily accessible to the user. Stated another way, it is important that the user seeking to locate a particular article in a particular tray may quickly find that item in a minimum of time. In this regard it is important that visibility of the shelves and the trays disposed thereon be favorable, and that the shelves, which often must be moved in and out, can do so repeatedly without binding or jamming. Also, the overall arrangement of shelves should be ergometric, so that users may readily use the apparatus with a minimum of inconvenience.

Prior art mail sorting apparatus is typified by the system of U.S. Pat. No. 3,269,788 which discloses an upright cabinet having a plurality of shelves arranged into columns and rows. A similar structure is seen in the sorting case of Bolling U.S. Pat. No. 2,570,636, wherein individual modules may be slidably adjusted.

Gurkin U.S. Pat. No. 4,732,279 discloses a mail sorting case in which a plurality of individual horizontal shelves are divided into individual letter receiving slots defined between partitions. Bourn U.S. Pat. No. 1,593,326 discloses an upright, generally cubical sorting arrangement wherein a plurality of spaced apart horizontal shelves are divided into specific compartments. The latter system is similar to Klein U.S. Pat. No. 4,795,042, issued Jan. 3, 1989 and Swank U.S. Pat. No. 4,913,501. The latter patent discloses a sorting tray which is pivotally disposed on top of a frame which can be moved to different angular positions. Other storage shelves of at least partial relevance include U.S. Pat. Nos. 3,807,572, 4,763,888, 4,193,650, 4,506,790.

However, to be effective within modern postal facilities, the cabinetry must be rigidly and solidly built to withstand continual reciprocal movement of trays. Although it is known to provide mail sorting cabinetry wherein trays slide in and out through suitable bearings mounted in various forms of tracks, I have determined that it is advantageous to provide .a system wherein trays can assume an outward position and at the same time tilt toward the user for purposes of access. By tilting shelves toward the user, ease of access is increased. On the other hand, it is important to provide a system wherein the shelves absolutely will not bind, even though they may be heavily loaded and often are carelessly moved in and out of proper position.

All of the foregoing notwithstanding, such cabinetry must be ergonomically designed for user access and must be user friendly. Such systems must be adapted for installation in relatively large and relatively small postal facilities, so that they must function together as modules. Finally, a minimum of sorting space must be taken by the apparatus.

SUMMARY OF THE INVENTION

My invention comprises a mail sorting rack for at least temporarily storing and easily accessing a multiplicity of trays filled with articles to be sorted. Although my cabinet system can be employed in a variety of different locations or for different purposes, it is primarily adapted to aid in the sorting of mail.

A rigid, generally cubical cabinet is formed from galvanized sheet metal and preferably rigidly coupled to the floor of the installation. One or more of the units may be employed in sideto-side relationship, and they may be arranged coherently in arrays of columns and rows. Each cabinet comprises a pair of rigid, sheet metal end panels which project vertically upwardly in generally parallel, spaced-apart relation. A plurality of vertically spaced apart retractable shelves are supported within the cabinet between the end panels. The shelves can be manually displaced from a retracted rest position within the cabinet interior to an extended position facilitating tray access. When pulled out from the cabinet, the shelves are tilted to readily facilitate user access to the trays disposed on the shelf.

A unique dynamic mounting system secures the shelves between the end panels for sliding. The mounting system comprises a pair of segmented tracks for each shelf, and suitable wheel bearings which are operatively coupled to the tracks. Preferably each segmented track system comprises a horizontal and angled track members mounted on the interior of the cabinet end panels. The horizontal track is at the front of the cabinet, and mounted substantially parallel with a lower supporting surface. The preferably separate, inwardly spaced apart and angled track is inclined with respect to the lower supporting surface, upwardly angularly diverging toward the open face of the cabinet.

Preferably the wheel bearings are secured to the shelves, outwardly projecting from each shelf end. However, as will be appreciated by those skilled in the art, the basic concepts of my invention include the concept of associating the tracks with the shelves, and rigidly mounting the bearings on the end walls. Pairs of wheel bearings are preferably mounted to both shelf ends with suitable bearing brackets. The front wheel bearings ride on the horizontal track and the rear wheel bearings ride on the angled track. Preferably, thrust bearings are mounted to the shelf ends and project beneath the wheel bearings toward the inner surfaces of the end panels Thus the track system is captured between the wheel bearings and the thrust bearings, so that binding forces are resisted, and vertical or other irregular shocking displacements to the shelves will not dislodge then from the track.

In one form of the invention the shelves are yieldably locked in either the retracted or withdrawn position by a notched, detent system defined in the tracks. Specifically, in the preferred mode I define suitable notches in the horizontal and angled tracks. In this fashion the wheel bearings will yieldably drop within the notches to position the shelves in the desired position. The shelves will thus be yieldably locked in the desired retracted position or extended position. When outwardly displaced for sorting, mechanical stability will insure worker safety.

Thus a primary object of my invention is to provide an ergometric mail sorting rack.

Another object of my invention is to provide a mail sorting rack of the character described in which the shelves slide in and out smoothly without binding.

A primary object of my invention is to provide a mail sorting rack of the character described which minimizes shelf extension.

Another object is to minimize the amount of floor space required in conjunction with the operation of mail sorting racks.

Another object of the present invention is to provide a mail sorting rack of the character described, which can be relatively easily formed from galvanized sheet metal so as to avoid the necessity of painting or repainting by the user after installation.

A similar object of the present invention is to provide a design of the character described in which the constituent parts will neatly fit together without welding, so that in the event parts become damaged or they wear out, they can easily be replaced in the field by the user.

Another object of my invention is to provide a redesigned shelf support track which eliminates side loading of shelf wheel bearings Another object is to provide a positive locking mechanism for shelves which yieldably locks them in position when either extended or retracted.

Another object of the present invention is to provide a mail sorting rack of character described which enables the use of only one wheel bearing mounting plate.

Yet another object of the present invention is to provide a mail sorting rack of the character described which may be employed in conjunction with a conventional take-away conveyor at the top of the cabinet.

Another object of the present invention is to provide a sorting tray rack of the character described with means for preventing individual shelves from accidentally being lifted off of the tracks.

Another object of the present invention is to provide a rack cabinet in which shelves will tilt downwardly for easy access by users when they are extended.

Another important object of the present invention is to provide a system wherein shelves can extend a limited distance from the cabinet when extended (preferably more than eight inches), so that the rack may be used in congested areas with limited space.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
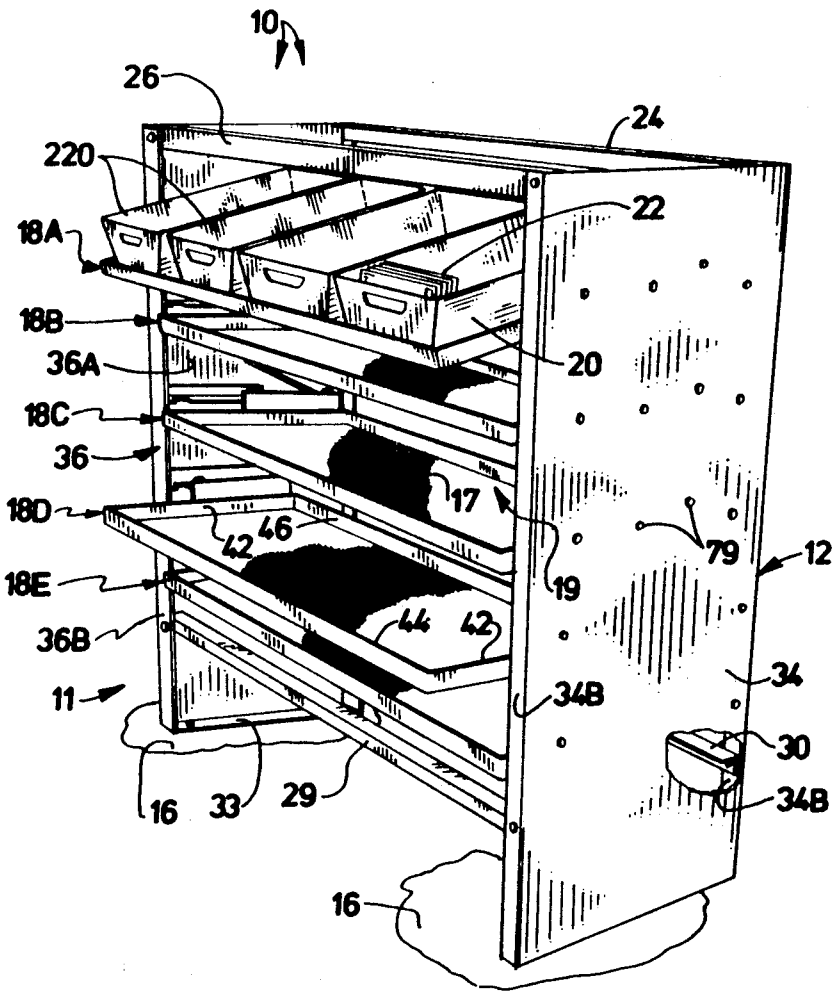
FIG. 1 is a fragmentary, isometric view showing a Mail Sorting Rack with portions thereof broken away or shown in section for clarity.

With initial reference now directed to FIGS. 1-5, my mail sorting rack has been generally designated by the reference numeral 10. Rack 10 comprises a rigid, somewhat cubical cabinet, generally designated by the reference numeral 12, which is normally bolted in position upon a supporting surface such as the lower, flat concrete floor 16. Cabinet 12 comprises a plurality of generally horizontally oriented vertically spaced apart shelves 18A-18E which are arranged at orderly intervals within the interior 19 of the cabinet 12, and accessible from the cabinet front 11. The shelves store a plurality of conventional sorting trays (FIGS. 1, 2) in which articles of mail 22 to be sorted are conventionally disposed. As best appreciated from an inspection of FIGS. 1 and 2, each shelf 18A-18E may be disposed in either a retracted position within the cabinet, or a displaced position partially withdrawn from the cabinet. Shelves 18A through 18C assume a substantially tilted position when withdrawn.

The cabinet 12 is reinforced by a pair of upper cross struts 24 and 26, and by a lower L-bracket struts 29 and 30. The cabinet comprises a pair of end panels 34, 36, which include inwardly turned lips 34B, 36B on its edges which secure struts 24, 26. End panels 34, 36 each has an inner surface such as surfaces 34A, 36A between which the shelves 18A-18E extend. The end panels and the shelves are preferably made of galvanized sheet metal. In the preferred embodiment the end panels are disposed substantially perpendicularly to surface 16, parallel with one another. The lower flanges 33 (FIG. 1) are bolted to the concrete floor. The shelves are disposed substantially parallel with floor 16 when assuming the retracted position.

Figure 5:
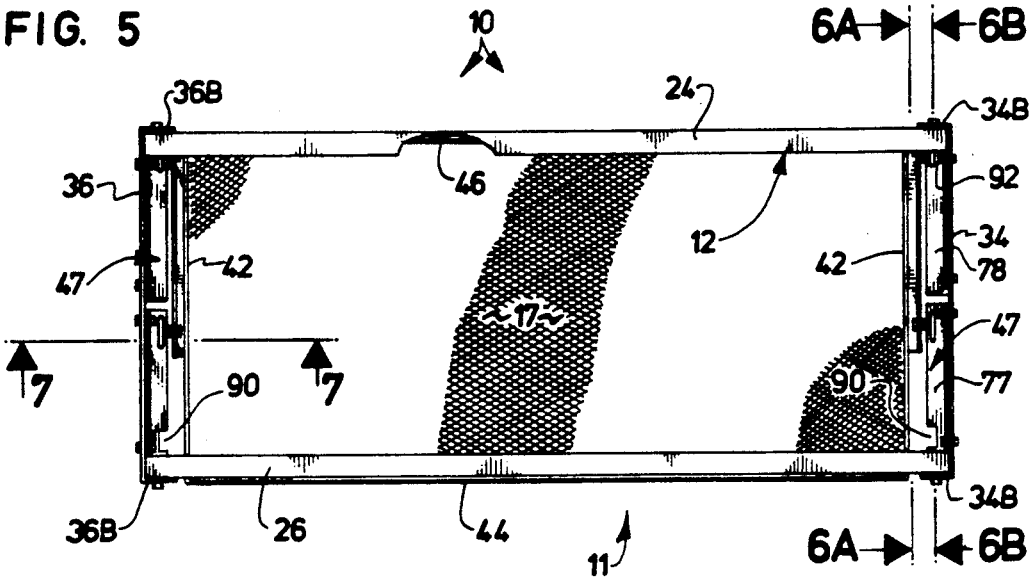
FIG. 5 is a fragmentary top plan view thereof, with portions thereof broken away or shown in section for clarity.
Figure 6A:
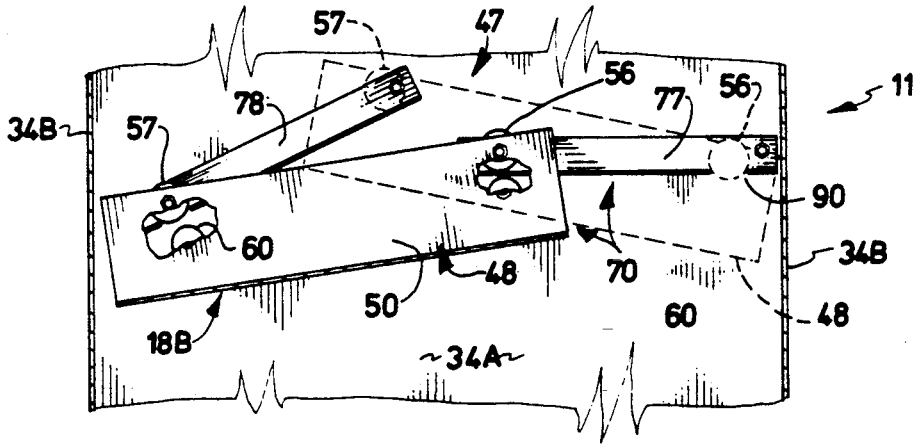
FIG. 6A is an enlarged, fragmentary, sectional view taken generally along line 6A—6A of FIG. 5.
Figure 6B:
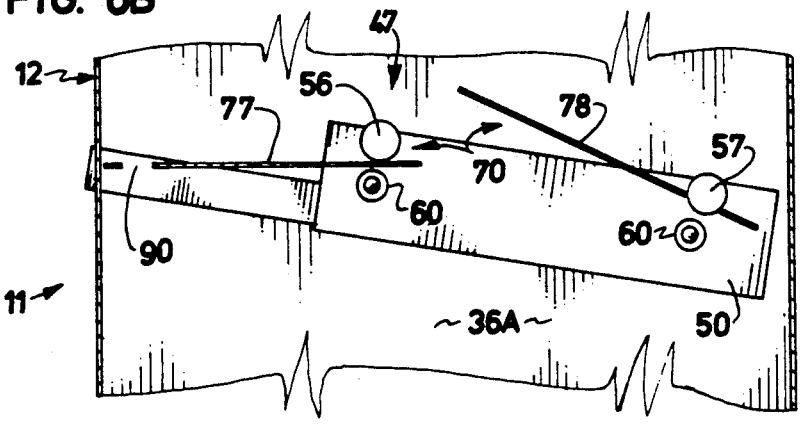
FIG. 6B is an enlarged, fragmentary, sectional view taken generally along line 6B—6B of FIG. 5.
Figure 7:
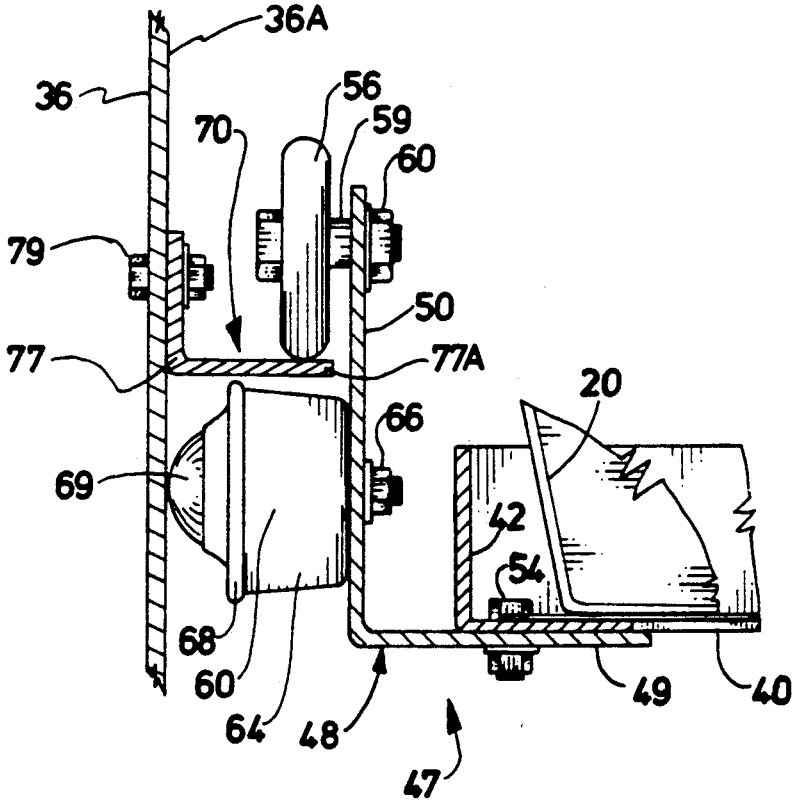
FIG. 7 is an enlarged, fragmentary, sectional view taken generally along line 7—7 of FIG. 5.

With additional reference concurrently directed now to FIGS. 5-7, shelf 18A is typical of the shelves 18A-18C. Each shelf is generally rectangular (FIG. 5) and includes a supporting surface 17 upon which the various trays 20 are regularly disposed. Each comprises a rigid, generally rectangular, galvanized plate 40 terminating in a right angled lip portion 42 which projects upwardly towards the top of the cabinet. The front lip 44 of the cabinet is spaced apart from the rear lip 46, of the shelf with the supporting surface 17 defined between lip edges 42, front 44 and rear 46.

My system for dynamically mounting the shelves, generally designated by the reference numeral 47, is disposed between the end of the shelves and the inner surfaces of the end panels such as inner surface 34A (FIG. 7) or 36A (FIG. 1). Each end of each shelf is secured to an elongated bearing mounting bracket 48 of generally L-shaped cross section (FIG. 7). Each bearing bracket includes a substantially horizontal portion 49 integral with an upwardly projecting, substantially vertical portion 50. The horizontally oriented lower portion 49 is secured to the ends of the shelves with a typical fastener 54. Each vertical bracket portion 50 mounts a pair of upper wheel bearings including a front wheel bearing 56 and a rear wheel bearing 57. Each wheel bearing includes a shaft 59 (FIG. 7) secured with a suitable nut 60 to the vertical portion 50 of the bearing bracket 48. Beneath each wheel bearing there is a side thrust bearing 60. Each thrust bearing 60 comprises a cylindrical housing 64 secured to the lip portion 50 of the mounting bracket 48 by a fastener 66. An outer peripheral rim 68 surrounds housing 64, and mounts a bearing 69 which projects towards the inner surface 34A of the end panel 34 (FIG. 7).

The preferred dynamic mounting system 47 also comprises a segmented track system which is generally designated by the reference numeral 70. The segmented track system, used with tilting shelves 18A–18C, supports the wheel bearings 56, 57, so that as shelves are withdrawn from the cabinet (i.e. move toward the front 11) they will tilt downwardly as shown in dashed lines in FIGS. 6A. With reference to FIG. 1, the withdrawn shelf 18A tilts downwardly so as to more readily expose the trays 20 for sorting. On the other hand retracted shelf 18B is nested within the interior of the cabinet and is oriented substantially horizontally. Non-tilting shelves 18D and 18E are respectively disposed in retracted and intermediate positions (FIG. 7).

Segmented track means 70 comprises an elongated, rigid metallic horizontal track 77, and a cooperating, spaced apart and separate angled track 78. Track 77 is substantially parallel with the ground surface 16 below, whereas track 78 forms an acute angle of approximately 30 degrees with respect to surface 16. Angled track segment 78 projects upwardly towards the front of the apparatus. Each track is formed of an elongated portion of angled steel which is fastened to the end panel with suitable fasteners 79.

It will be appreciated best from FIG. 7 that in each case the tracks are captured between the wheel bearing and the thrust bearing. Specifically, it will be noted that the wheel bearing 56 actually rides on the shelf portion 77A of the track, whereas the thrust bearing 60 is disposed beneath portion 77A, with its rim portion 68 spaced very closely. Thus the track is captivated. Relative vertical displacements of the shelves without being moved laterally are thus tightly regulated. Horizontal shifts from left to right are similarly resisted by contact with the bearing surface 69 from the thrust bearings with the inner surfaces of the end walls.

As a shelf 18A–18C slides outwardly from the retracted position, its front wheel bearings will ride along the horizontal track at an approximately constant elevation above surface 16. The rear bearings, however, will be displaced vertically upwardly relative to surface 16. The rear of the shelf will thus be pivoted upwardly, so that the shelf from assumes a lower position and thus becomes tilted. Trays disposed on the shelves are much easier to sort when presented in this fashion.

A detent system is preferably included within the dynamic mounting means for insuring the trays yieldably maintain either the retracted or withdrawn positions. With primary reference now directed to FIGS. 2, 6A and 6B, each horizontal track 77 includes a front notch 90 which is located such that bearing 56 will drop into it when the shelf is withdrawn appropriately. At this time, rear bearing 57 disposed on the angled track (FIG. 2) will not be received within a notch, so that merely by lifting the withdrawn end of tray 18A, it will be very easy to thereafter push the tray back into the retracted position. When the tray drops into the retracted position (as is tray 18B, FIG. 2), the rear wheel bearing 57 will be received within a suitable notch 92 defined in the angled tract 78, so that the tray will be yieldably maintained within the retracted position.

Figure 2:
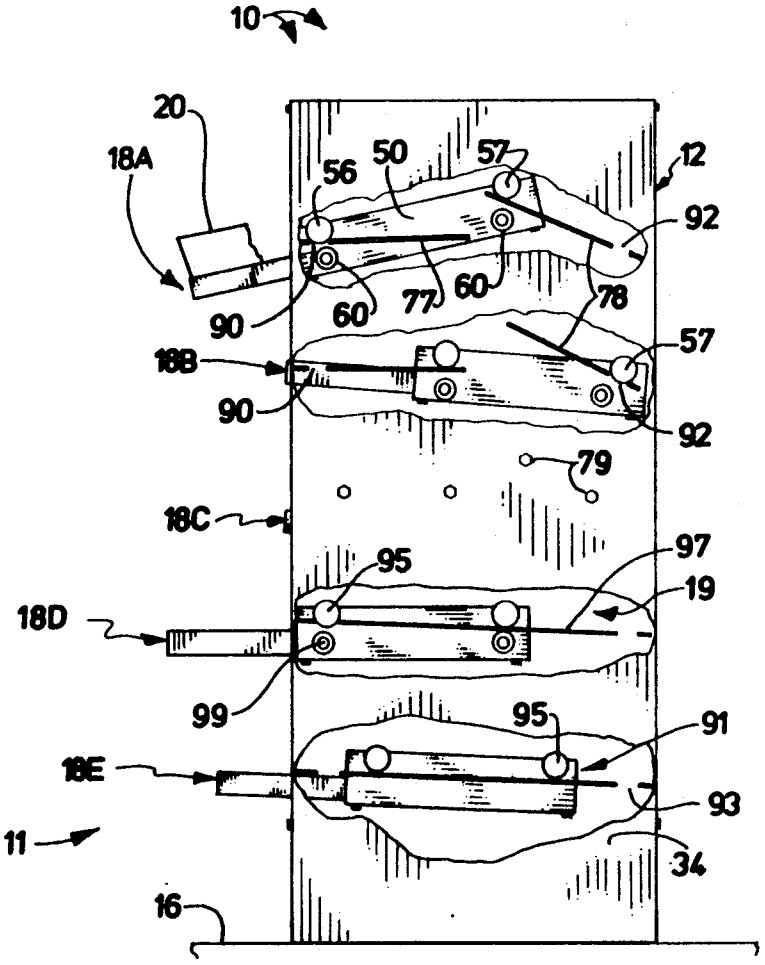
FIG. 2 is a fragmentary, right side elevational view thereof, with portions thereof broken away or shown in section for clarity.
Figure 3:
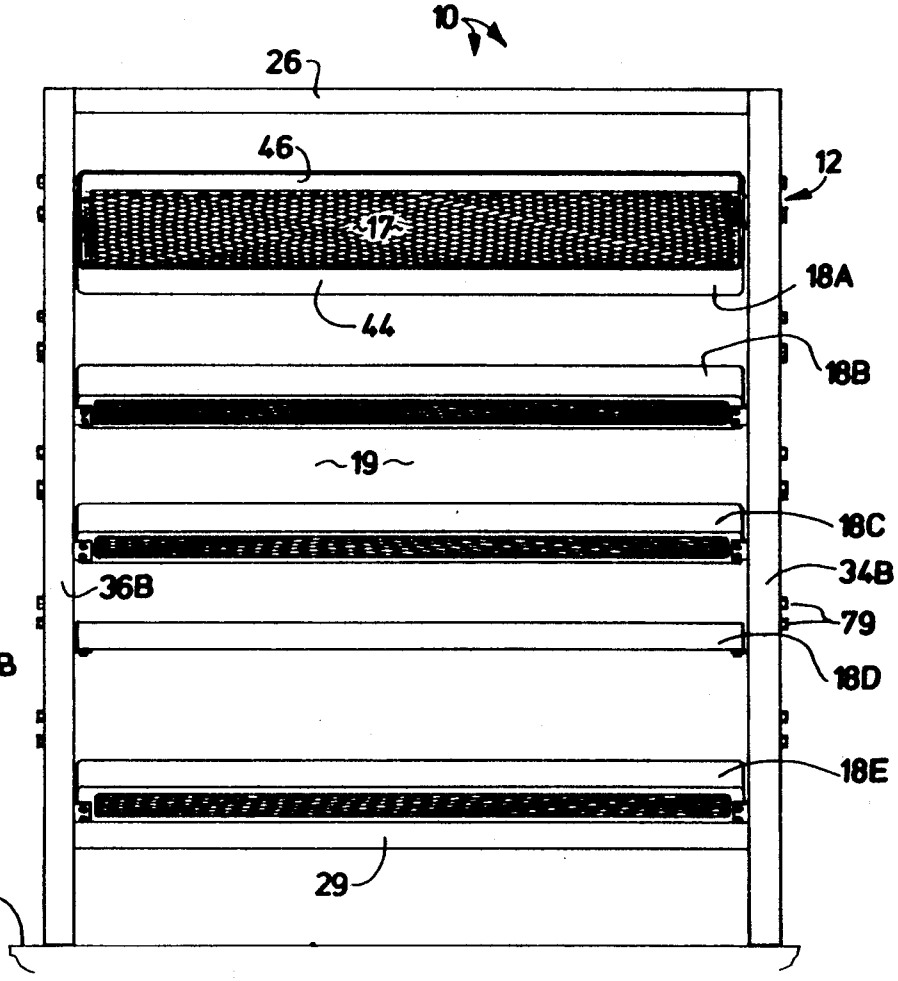
FIG. 3 is a front plan view thereof.
Figure 4:
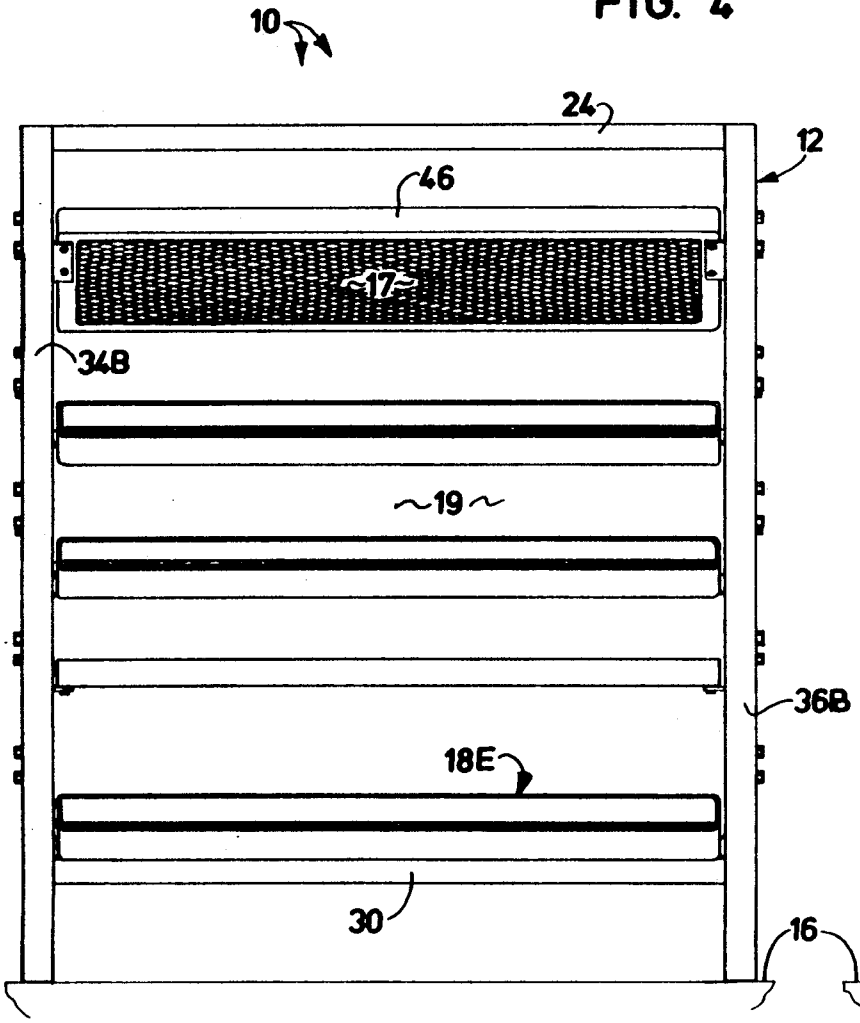
FIG. 4 is a rear plan view thereof.

As seen in FIG. 2, a detent system 91, including notches 93 defined in tracks 97, is also employed with the non-tilting shelves 18D, 18E. Bearings 95 ride on the tracks, and may be received within notches 97 to yieldably maintain the shelves in either a retracted or withdrawn position. As before, thrust bearings 99 are employed beneath the bearings 95 to captivate the tracks 97.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A rack for storing articles, said rack comprising:

a rigid, generally upright cabinet adapted to be disposed upon a supporting surface;

a plurality of vertically spaced-apart, retractable shelves extending generally horizontally within said cabinet for receiving said articles, said shelves adapted to be selectively at least partially withdrawn from said cabinet to permit convenient access to said articles;

track means for slidably securing said shelves so that when pulled from said cabinet they will tilt downwardly to readily expose articles disposed thereon, said track means comprising a horizontal track substantially parallel with said supporting surface and an angled track substantially inclined with respect to said supporting surface and, wheel bearing means coupled to said track means for concurrently contacting both said horizontal track and said inclined track to insure tilting of said shelves during withdrawal from said cabinet.

2. The rack as defined in claim 1 further comprising detent means defined in said track means for yieldably restraining said wheel bearing means to temporarily maintain said shelves in a withdrawn or rest position.

3. The rack as defined in claim 1 further comprising thrust bearing means disposed between said shelves and said end panels for aligning said shelves to prevent binding.

4. The rack as defined in claim 3 wherein said track means is trapped between said wheel bearing means and said thrust bearing means.

5. The rack as defined in claim 4 further comprising detent means defined in said track means for yieldably restraining said wheel bearing means to temporarily maintain said shelves in a withdrawn or rest position.

6. The rack as defined in claim 5 wherein said cabinet comprises a pair of generally vertical, rigid end panels and said shelves extend between said end panels within said cabinet.

7. The rack as defined in claim 6 wherein said track means is secured to said end panels and said wheel bearing means is rotatably secured to said shelves.

8. The rack as defined in claim 7 wherein said wheel bearing means rides upon said track means, and said thrust bearing means is secured to said shelves and projects toward said end panels beneath said track means.

9. A rack for storing trays of articles to be sorted, said rack comprising:

a rigid, generally cubicle upright cabinet having an interior defined between a pair of end panels, said cabinet adapted to be disposed upon a supporting surface;

a plurality of vertically spaced-apart, retractable shelves extending generally horizontally between said end panels for receiving and storing said trays, said shelves manually displaceable from a rest position within said cabinet interior to a partially withdrawn position to display said trays;

means for mounting said shelves so that when withdrawn they will be oriented at a downwardly tilted angle to readily expose said trays without escaping from said cabinet, said mounting means comprising:

track means coupled to said end panels for slidably suspending said shelves for movement within said cabinet, said track means comprising a horizontal portion thereof oriented substantially parallel with said supporting surface;

wheel bearing means coupled to said shelves for contacting said track means;

thrust bearing means disposed between said shelves and said end panels for aligning said shelves to prevent binding; and, wherein said horizontal portion of said track means is captured between said wheel bearing means and said thrust bearing means.

10. The rack as defined in claim 9 wherein said track means comprises a horizontal track substantially parallel with said supporting surface and a separate, spaced apart angled track substantially inclined with respect to said supporting surface.

11. The rack as defined in claim 9 wherein said mounting means comprises detent means for yieldably restraining said wheel bearing means to temporarily maintain said shelves in a withdrawn or rest position.

12. The rack as defined in claim 11 wherein said wheel bearing means rides upon said track means, and said thrust bearing means is secured to said shelves and projects toward said end panels beneath said track means, whereby to capture said track means.

13. The rack as defined in claim 12 wherein said track means comprising a horizontal track substantially parallel with said supporting surface and a separate, spaced apart angled track substantially inclined with respect to said supporting surface.

14. A mail sorting rack for at least temporarily storing multiple trays of articles to be sorted, said rack comprising:

a rigid, generally cubicle, cabinet comprising a pair of spaced apart, generally parallel end panels, said cabinet adapted to be disposed upon a supporting surface;

a plurality of vertically spaced-apart, retractable shelves extending generally horizontally between said end panels for receiving said trays, said shelves manually displaceable from a rest position within said cabinet to a partially withdrawn position offering access to said trays;

means for dynamically mounting said shelves so that when withdrawn they will tilt downwardly to readily expose said trays without escaping from said cabinet, said mounting means comprising:

segmented track means coupled to said end panels for slidably suspending said shelves for movement within said cabinet, said segmented track means comprising a horizontal track substantially parallel with said supporting surface and a separate, spaced-apart, angled track substantially inclined with respect to said supporting surface;

wheel bearing means for coupling said shelves to said track means, said wheel bearing means comprising a front shelf bearing for contacting said horizontal track and a rear shelf bearing for contacting said inclined track to tilt said shelves during movement upon said track means; and, thrust bearing means projecting from said shelves into contact with said end panels for aligning said shelves to prevent binding.

15. The rack as defined in claim 14 wherein said track means is trapped between said wheel bearing means and said thrust bearing means.

16. The rack as defined in claim 15 wherein said mounting means comprises notched detent means for yieldably restraining said wheel bearing means to temporarily maintain said shelves in a withdrawn or rest position.

* * * * *